United States Patent [19]

Naito

[11] Patent Number: 4,881,372

[45] Date of Patent: Nov. 21, 1989

[54] STIRLING ENGINE

[75] Inventor: Yoshihiro Naito, Nagoya, Japan

[73] Assignee: Aisin Seiki Kabushiki Kaisha, Kariya, Japan

[21] Appl. No.: 316,853

[22] Filed: Feb. 28, 1989

[30] Foreign Application Priority Data

Feb. 29, 1988 [JP] Japan ..... 63-048084

[51] Int. Cl.[4] ..... F02G 1/04

[52] U.S. Cl. ..... 60/521; 60/641.14; 60/641.8; 60/659; 60/524

[58] Field of Search ..... 60/517, 521, 522, 524, 60/641.8, 641.14, 659

[56] References Cited

U.S. PATENT DOCUMENTS

| | | | |
|---|---|---|---|
| 3,080,706 | 3/1963 | Flynn, Jr. et al. | 60/659 |
| 4,126,995 | 11/1978 | Åsselman et al. | 60/524 |
| 4,457,133 | 7/1984 | Almstrom et al. | 60/524 |

FOREIGN PATENT DOCUMENTS

| | | | |
|---|---|---|---|
| 0178545 | 8/1986 | Japan | 60/524 |

*Primary Examiner*—Allen M. Ostrager

*Attorney, Agent, or Firm*—Burns, Doane, Swecker & Mathis

[57] ABSTRACT

A Stirling engine includes a heater device for collecting solar radiation energy, a heater tube disposed in the heater device and connecting the expansion space and the compression space of cylinder containing a piston, and a transparent partition located in the heater device for defining a closed space. A heat storage material is positioned in the closed space and a temperature detecting apparatus is provided for detecting the temperature of the heat storage material. A pressure regulating arrangement regulates the pressure of a working gas in a working space located between the expansion space and the compression space of the cylinder. A control device controls the pressure regulating arrangement in response to a signal from the temperature detecting apparatus.

8 Claims, 8 Drawing Sheets

STIRLING ENGINE

BACKGROUND OF THE INVENTION

1. Field of the Invention

The present invention relates to a Stirling engine. More particularly, the present invention relates to a solar-powered Stirling engine and a method for controlling the output of such an engine.

2. Description of Related Art

U.S. Pat. No. 4,457,133 discloses a conventional solar-powered Stirling engine that includes a plurality of cylinders. In each cylinder, a piston is movably mounted and an expansion space and a compression space are defined across the piston. The compression space is in fluid communication with a neighboring expansion space via a heater, a regenerator and a cooler. Reciprocal movements of each piston are converted into a rotating torque at an output mechanism and the resulting torque is transmitted to a suitable mechanism such as a dynamo.

A working gas such as helium gas or hydrogen gas is filled in a working space that includes the expansion space, the compression space and the aforementioned other members located therebetween, and the gas is heated by solar radiation energy while it passes through pipes. The working space is connected to a gas-reservoir via a minimum-cycle-pressure line which includes a check-valve and a pressure-increasing valve. The working space is also connected to the gas reservoir via a maximum-pressure-line which includes a check valve, a pressure-decreasing valve and a compressor. As a result of that construction, when the pressure-increasing valve is opened, the average pressure is increased and the engine output is increased. Alternatively, when the pressure-decreasing valve is opened, the average pressure is decreased and the engine output is decreased.

In the conventional Stirling engine, the engine-output is controlled as follows:

(1) Since a temperature T of the gas in the pipes is proportional to an integration value of (Qin−Qout), where Qin and Qout are defined as the quantity of solar energy and the quantity of heat-transfer to the gas respectively, the integration value should be 0 so that T may be equal to Tset which is dependent upon the ability and/or rating of the Stirling engine.

(2) Since a pressure P of the gas is proportional to the quantity of heat-transfer to the gas, a linear region corresponding to Qin=Qout is obtained when P is set to Qout for example. Thus, an output region of the Stirling engine which depends on the minimum or idle pressure and the maximum pressure, results in the determination of the maximum value and the minimum value of Qin. Therefore, the operating range of the engine can be determined.

Consequently, the pressure P can be controlled in response to the variation of Qin within the operating range derived from the above-items (1) and (2), thereby keeping the equivalence of Qin and Qout or the equation Qin=Qout. In light of this fact, in the conventional Stirling engine, the variable temperature T of the gas in the pipe according to the variation of Qin is detected, the difference between T and Tset is calculated, and the pressure P is varied according to the resulting difference to thereby keep the temperature of the gas at a set value. Thus, the output of the engine is maintained at a set value.

However, since solar radiation varies abruptly in magnitude, the temperature of the gas in the pipe varies in a similar manner. Thus, to maintain the temperature of the pipe at a set value, the pressure of the gas must be quickly adjusted in a precise manner. However, since the control of the pressure of the gas cannot be easily performed, the engine output becomes unstable. Further, in order to control the pressure of the gas in that manner, the valves for increasing the pressure and for reducing the pressure should have a special construction that permits the valves to be controlled in a precise manner and which permits a large amount of gas to be passed therethrough. However, the construction of such a valve can be very expensive.

SUMMARY OF THE INVENTION

It is, therefore, a principal object of the present invention to provide a Stirling engine from which a stable or a constant output can be obtained in spite of variations in solar radiation.

DETAILED DESCRIPTION OF THE PREFERRED EMBODIMENT

Figure 1:
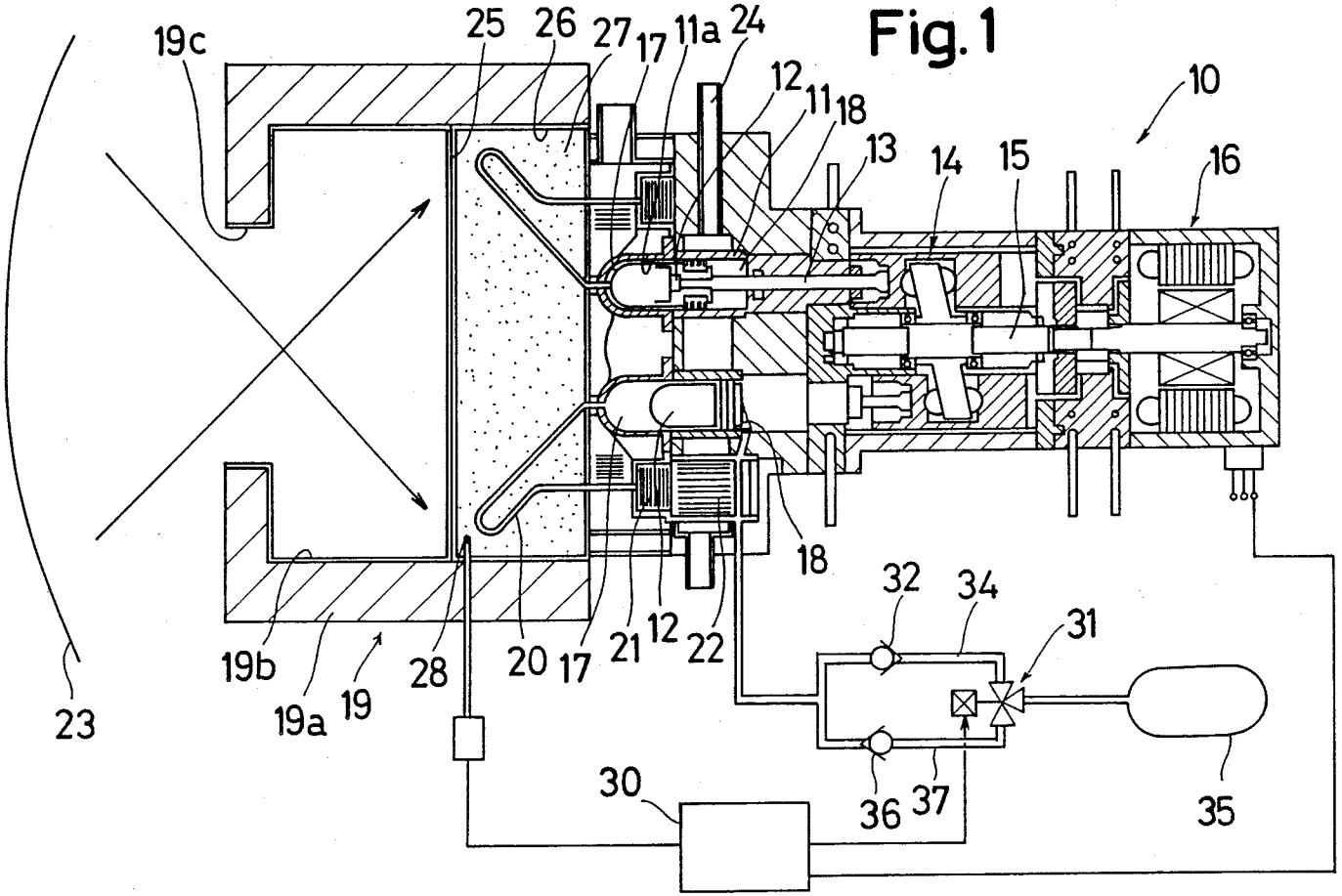
FIG. 1 is a cross-sectional view of a Stirling engine according to one embodiment of the present invention.

Referring now to FIG. 1, a solar-powered Stirling engine 10 includes a housing 11 having four cylinders 11*a* (only two of which are shown) located therein. In each cylinder 11*a*, a piston 12 is slidably or movably mounted. Each piston 12 is connected via a rod 13 to a swash-plate mechanism 14 that serves as an output deriving mechanism. Two neighboring pistons 12, 12 are positioned 90 degrees out of phase with respect to each other and consequently, as the pistons 12, 12 move, an output shaft 15 of the swash-plate 14 is rotated and the resulting rotation is transmitted to a dynamo 16 which generates AC current.

In each cylinder 11*a*, an expansion space 17 and a compression space 18 are defined across the piston 12. Spaces 17 and 18 vary in volume due to reciprocal movement of the piston 12 in such a manner that the volume of the expansion space 17 is a maximum when the volume of the compression space 18 is a minimum and vice versa.

The expansion space 17 is in fluid communication with the compression space 18 via a set of pipes or tubes 20. The pipes 20 extend in an inner portion 19*a* of the heating means 19 and are connected to a regenerator 21 and a cooler 22, thereby defining a working space. The working space is filled with working gas such as helium gas, hydrogen gas or the like. Heated working gas which moves reciprocally between the expansion space 17 and the compression space 18 brings the pistons 12 into reciprocal motion, thereby constituting a Stirling cycle. For heating the working gas, solar radiation energy is employed. Solar radiation energy is collected by reflector 23 which follows the sun and the resulting energy is supplied to the tubes 20 as a high-temperature source through an opening of the housing 19*a* of the heater means 19. It is noted that cooling water flows through a conduit 24 so as to be heat-exchanged with the working gas in the cooler 21 and the tubes 20 are arranged in the radial direction.

Within the inner portion 19*b* of the housing 19*a*, a transparent partition 25 with good thermal conductivity, good thermal resistance and good corrosion resistance is disposed, thereby defining a closed space 26 within which the tubes 20 are located. Examples of the heat storing material 27 which can store heat are NaCl, $Li_2CO_3$, $MgCl_2$, etc., which store latent heat. It is desirable that the heat-storing material 27 possess good thermal conductivity, good thermal resistance and good corrosion resistance.

Also, within the closed space 26, a temperature sensor 28 in the form of thermocouple is disposed for detecting the temperature of the heat-storing material 27. The detected temperature is transmitted in the form of signals to a control unit 30.

The working space is in fluid communication with a gas reservoir 35 via a minimum-cycle-pressure line 34 which includes a check-valve 32 and a switching valve 31 and via a maximum-cycle-pressure line 37 which includes a check-valve 36 and the switching valve 31. The switching valve 31 is an electromagnetic valve of the 3-port/2-position type and is under the control of the control unit 30 so that change from one state to the other may take place according to the signals from the temperature sensor 28. Under one state of the switching valve 31, the gas reservoir 35 is in fluid communication with the maximum-cycle-pressure line 37 and is out of fluid communication with the minimum-cycle-pressure line 34. When the switching valve is in the other state, the gas reservoir 35 is in fluid communication with the minimum-cycle-pressure line 34 and is out of fluid communication with the maximum-cycle-pressure line 37. It is noted that the pressure of the gas which is stored in the gas reservoir 35 is equal to the maximum pressure of the working gas in the working space.

Figure 3:
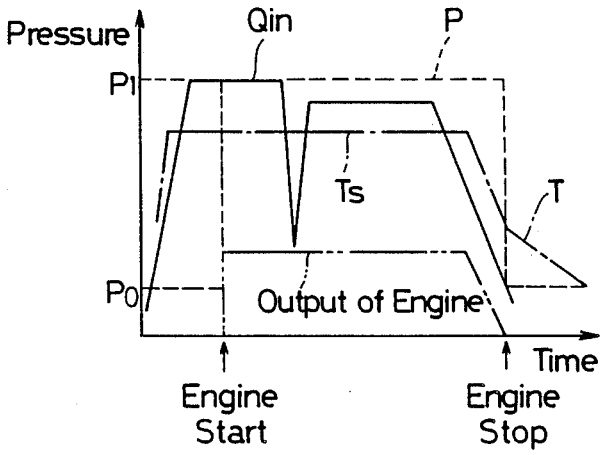
FIG. 3 shows a time chart during a first operation mode of the engine.
Figure 4:
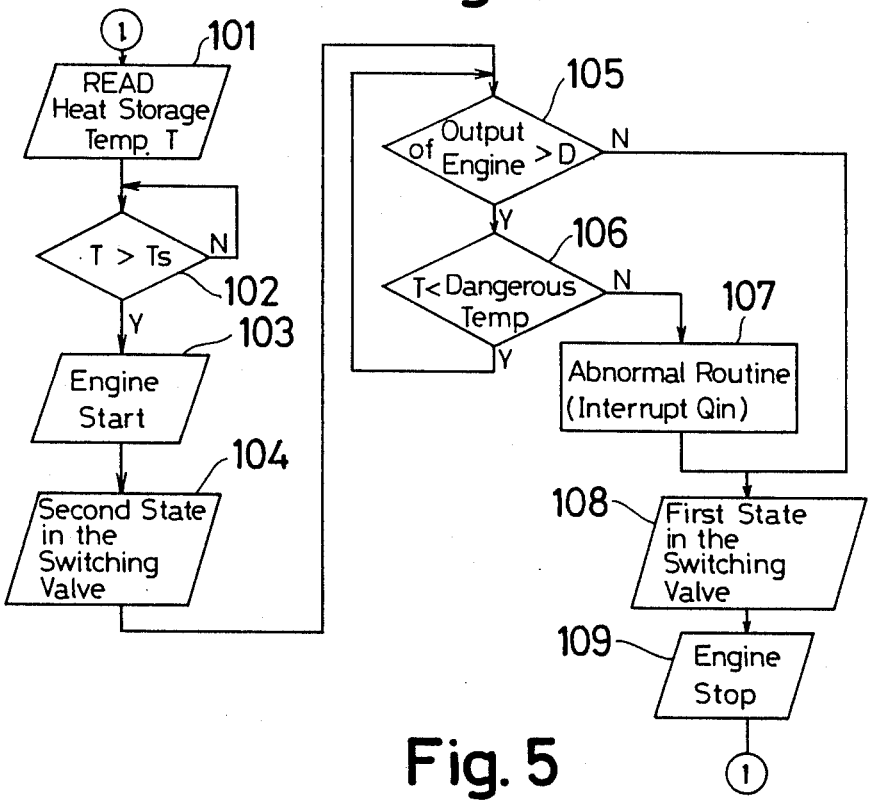
FIG. 4 shows a flow chart of the first operation mode of the engine.

Operation of the above-described Stirling engine 10 will be described hereinafter with reference to FIG. 3 showing a time chart and FIG. 4 showing a flowchart.

Figure 2:
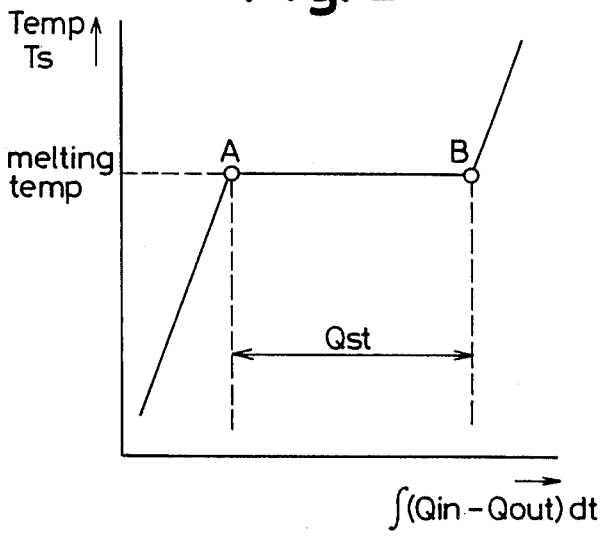
FIG. 2 is a graph showing the relationship between the temperature of the heat-storing material and an integration of the term (solar radiation energy - quantity of heat transfer to tubes)

The solar radiation energy and the quantity of heat transfer to the tubes 20 are defined by symbols Qin and Qout respectively, and the temperature T of the heat-storing material 27 is proportional to the integration value of the expression (Qin − Qout) as shown in FIG. 2. However, it is to be noted that the temperature T of the heat-storing material 27 does not change at the melting point thereof. That is to say, from the beginning of the melted condition of the material 27 (point A) to the fully melted condition (point B) of the material 27, the temperature T of the material 27 is constant and the latent heat, whose quantity is represented by Qst, is stored in the heat-storing material 27. Thus, it is desirable that the temperature T of the heat-storing material 27 be set below its melting point in order to prevent the boiling of the material 27 and the breakage of the partition 25.

When vacuum bubbles are generated around the tubes 20 during a phase change in the heat-storing material 27, the temperature difference between the heat-storing material 27 and the tubes 20 is increased. Thus, measuring the temperature of the tube 20 by a thermal sensor is likely to raise the temperature T of the heat-storing material 27 above its melting point. In recognition of that fact, in the present invention, the temperature T of the heat-storing material 27 is measured or detected by the thermosensor 28 and the melting point Ts of the heat-storing material 27 is regarded as an optimal operation temperature Tset. For maintaining Ts at a value, the pressure of the working gas is controlled through operation of a pressure regulating means that includes the valves 31, 32 and 36.

In FIG. 4, when the Stirling engine reaches the steady operating condition, the detected temperature T of the heat-storing material 27 by the thermosensor 28 is transmitted as signals to the control unit 30 in step 101. In step 102, the temperature T is compared to Ts to determine whether the detected temperature T is greater than the temperature Ts.

In step 102, if the answer is no and the detected temperature T of the heat-storing material 27 is less than Ts, step 101 is again executed. If the answer in step 102 is yes, step 103 is then executed. It should be noted that the switching valve 31 is held at one position before the temperature T of the heat-storing material 27 is raised up to the melting point Ts, thereby maintaining the pressure of the working space at the idle pressure. Thus, the temperature T of the heat-storing material 27 begins to raise abruptly. At the time that the temperature T of the heat-storing material 27 reaches the melting point Ts, the temperature T is located at point A on the graph shown in FIG. 2 and the pressure P of the working gas is kept at the idle pressure. Thus, any increase in Qin is consumed for melting the heat-storing material 27 and the temperature of the heat-storing material 27 remains constant.

In step 103, a starter (not shown) which can be replaced by the AC dynamo 16 drives the shaft 15 of the swash-plate mechanism which results in the pistons 12 being brought into reciprocal movement. Simultaneously, the solar radiation energy Qin heats the tubes 20 through the heat-storing material 27, thereby bringing the engine 10 into independent operation. Then, the switching valve 31 is switched into the other state by the control unit 30 in step 104, thereby raising the pressure P in the working space up to the maximum value. Thus, the quantity of heat transfer to the tubes 20 is maximized and the output of the engine 10 begins to increase. Thereafter, despite any decrease in solar radiation energy Qin, Qout is kept at a particular value by consuming the heat stored in the material 27. During this process, there is no need to control the pressure regulating means quickly and precisely. Thus, stable output can be obtained from the engine 10. Upon further decrement of Qin after consumption of Qst, the engine 10 stops. That is to say, if the output of the engine 10 is zero in step 105, the switching valve 31 is switched back to the one state in step 108, and the engine 10 is stopped in step 109.

If the output of the engine is not zero in step 105, a check is performed whether the temperature T of the heat-storing material 27 is below a dangerous temperature. If the temperature T is below a dangerous amount, step 105 is performed again. If the temperature T is not below a dangerous temperature, an abnormal routine is performed in step 108 so as to close the opening 19*c* for interrupting solar radiation, the switching valve 31 is switched back to the one state in step 108, and the engine 10 is stopped in step 109.

Figure 5:
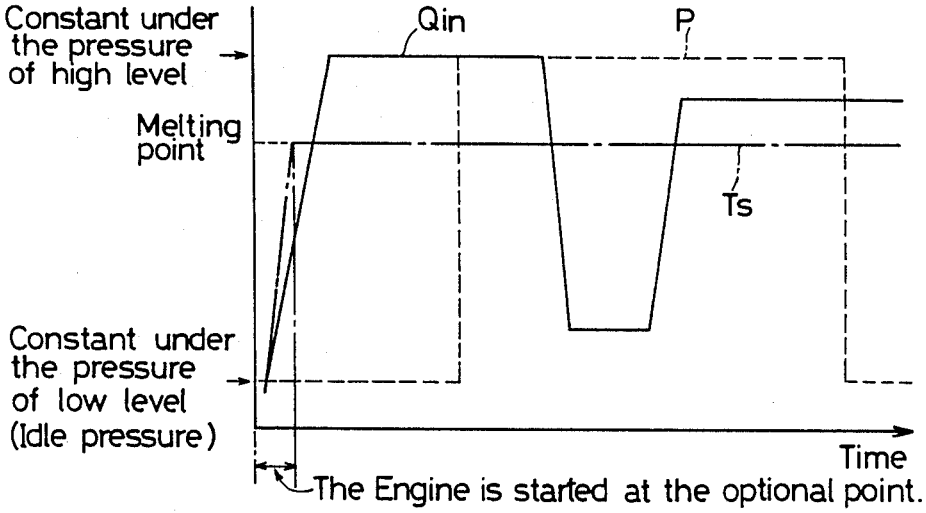
FIG. 5 shows a time chart during a second operation mode of the engine.
Figure 6:
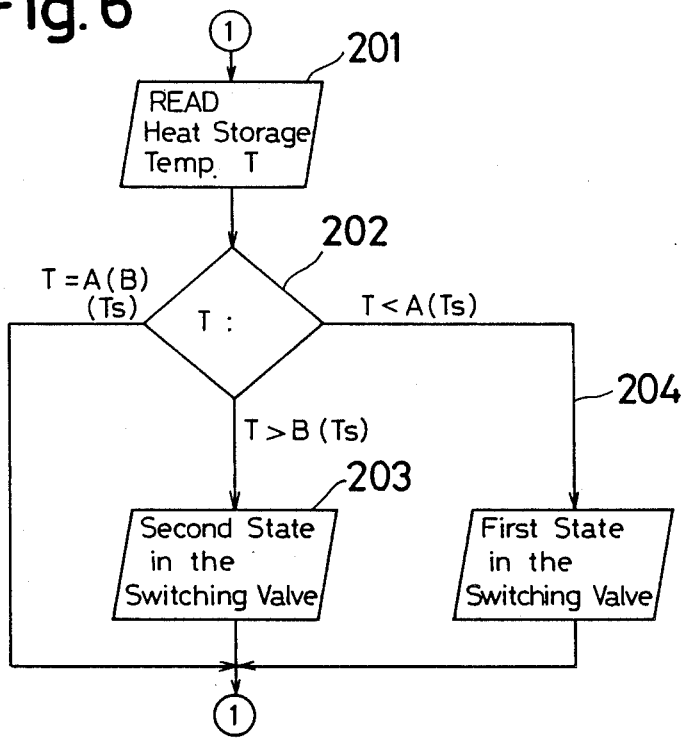
FIG. 6 shows a flow chart of the second operation mode of the engine.

FIG. 5 shows a time chart and FIG. 6 shows a flow chart according to a second mode of operation of the present invention. The construction of the engine whose time chart is depicted in FIG. 5 and whose flow chart is depicted in FIG. 6 is the same as shown in FIG. 1.

In this operation mode, the pressure of the working gas in the working space is controlled in 2-stages, a minimum operating pressure (Qin-min) and a maximum operation pressure (Qin-max).

In FIG. 5, the temperature T of the heat-storing material 27 raises as the solar radiation energy Qin increases, and the switching valve 31 is held at one state thereof before the temperature T reaches point B. Thus, the pressure P in the working space is held at a minimum or idle pressure. As soon as the temperature T of the heat storing material 27 reaches point B, wherein the temperature T exceeds the melting point Ts, the switching valve 31 is changed to the other state thereof, thereby maximizing pressure P in the working space. Thus, Qout is maximized. Thereafter, when Qst is consumed as Qin is decreased or as the temperature T of the heat-storing material 27 is returned to the point A at which the temperature T is below the melting point Ts, the switching valve 31 is changed back to the one state thereof, thereby minimizing the pressure P in the working space. This results in the decrease of Qout and the increase of the heat in the material 27. When the temperature T of the heat-storing material 27 reaches the point B again, the switching valve 31 is changed back to the other state thereof, thereby maximizing the pressure P in the working space.

The foregoing operation mode is detailed in the flow chart shown in FIG. 6. That is to say, the temperature T of the heat-storing material 27 is transmitted to the control unit 30 in step 201, and the temperature T of the heat-storing material 27 is compared to the melting point Ts thereof in step 202. If T is equal to Ts, step 201 is executed again. If T is greater than Ts, the switching valve 31 is switched to the other state thereof in step 203. If T is less than Ts, the switching valve 31 is switched to the one state thereof in step 204. Consequently, in this operation mode, the frequency of the switching operation is less due to utilization of the stored heat in the material 27.

Figure 7:
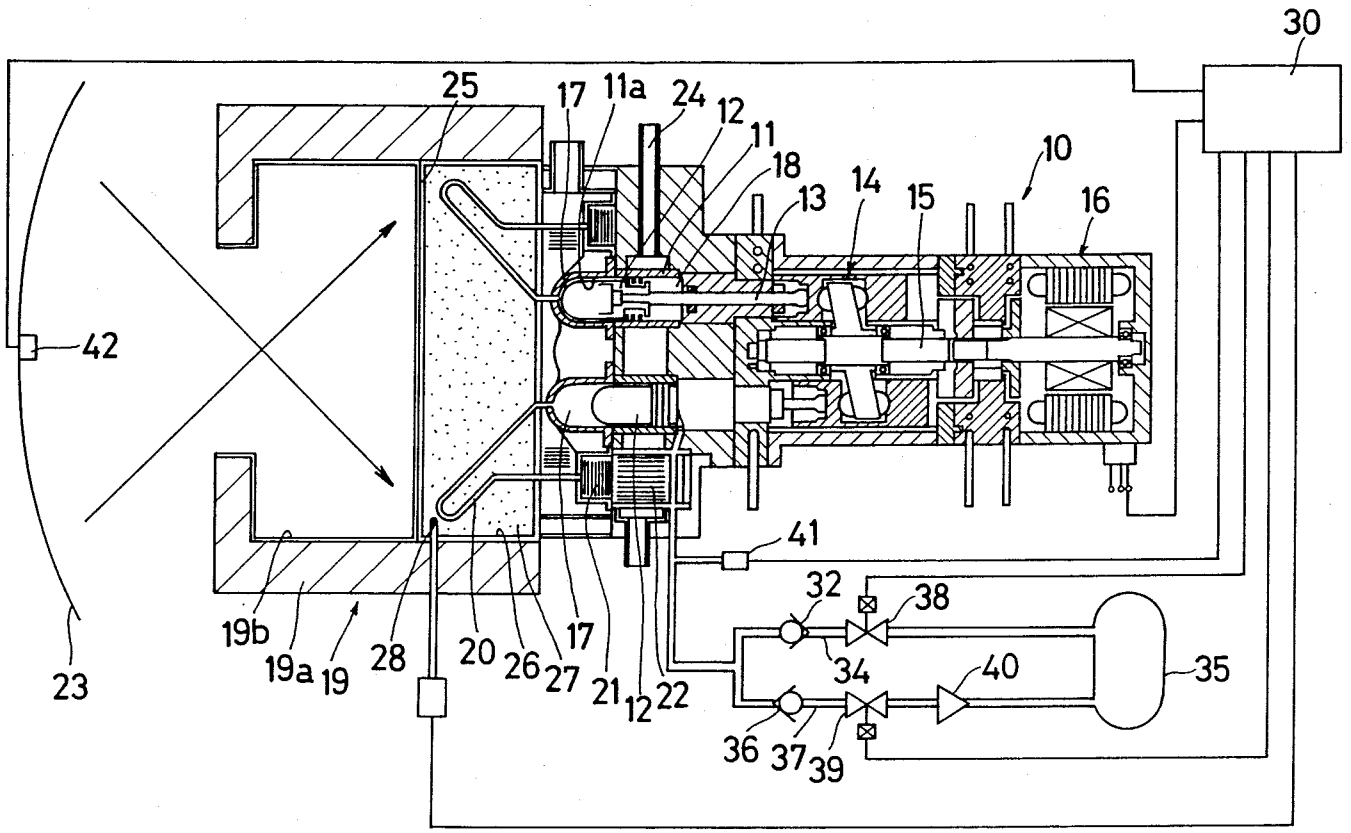
FIG. 7 is a cross-sectional view of a Stirling engine according to another embodiment of the present invention.

In FIG. 7, there is illustrated a second embodiment of the present invention. The features of this embodiment are as follows. A pressure-increasing valve 38 and a pressure-decreasing valve 39 are disposed in the maximum pressure line 34 and the minimum pressure line 37 respectively, and are operable independently of each other. Between the pressure-decreasing valve 39 and the gas reservoir 35, there is interposed a compressor 40. In a conduit that connects each working space and the valves 32 and 36, there is interposed a pressure sensor 41. The pressure that is detected by the sensor 41 is transmitted as a signal to the control unit 30. On the reflector 23, there is provided a device 42 for measuring the heat quantity of solar radiation energy Qin and the measured quantity is transmitted as a signal to the control unit 30.

Figure 9:
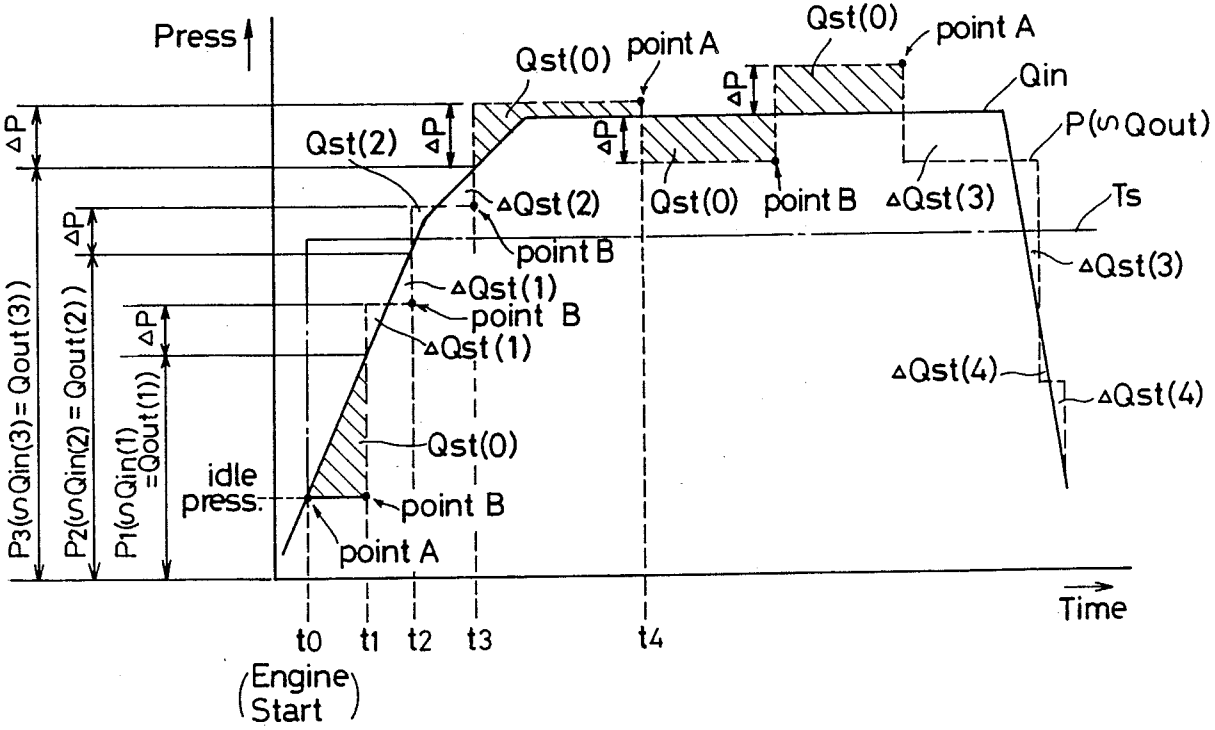
FIG. 9 shows a time chart during a third operation mode of the engine.

In FIG. 9, before the temperature T of the heat-storing material 27 reaches the point B, the pressure P of the working space is kept at an idle pressure. As soon as the temperature T of the heat-storing material 27 reaches the point B, the pressure P of the working space is set by adding a value ΔP to the pressure corresponding to Qin=Qout. Since the quantity of heat transfer to the tubes 20 is represented by Qout+Qst(1), the supply of ΔQst(1) from Qst in the material 27 brings the temperature T towards point A from point B. Since Qin is increased, Qst(l) is returned to Qin and the temperature T of the material 27 is again transferred to point B. At this time, the pressure P of the working space is set by adding ΔP to the pressure corresponding to Qin. Hereinafter, ΔP is added whenever temperature T of the material 27 is transferred to the point B.

Figure 8:
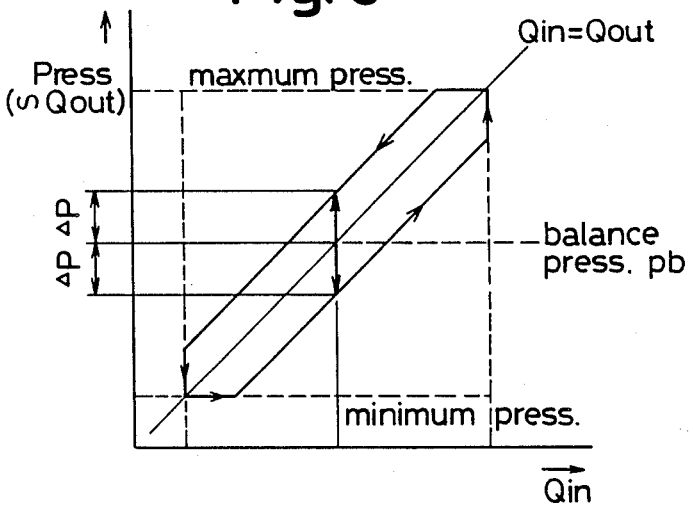
FIG. 8 is a graph showing the relationship between the temperature of the heat-storing material and an integration of the term (solar radiation energy—quantity of heat transfer to tubes) in a third operation mode of the engine.

When Qin no longer increases, the quantity (Qout +Qst(0)), which is derived from the working gas upon increasing the pressure by ΔP, becomes larger than Qin to be supplied to the material 27. The temperature of the heat storing material is not able to return to point B and reaches point A. The pressure is then decreased by ΔP and thus, an amount of heat represented by (Qin−Qst(0)) is stored in the material 27. When that stored quantity becomes Qst(0), the temperature T of the material 27 once again reaches the point B and the pressure P is changed by adding ΔP. Hereinafter, when Qin is constant, the pressure P draws an endless loop as shown in FIG. 8.

Next, when Qin decreases, the temperature T of the heat-storing material 27 cannot return to point B and reaches point A. In this case, the pressure P of the working gas is decreased by ΔP. If the temperature T of the heat-storing material 27 cannot return to point B despite that operation, further decrement of ΔP is performed.

Figure 10:
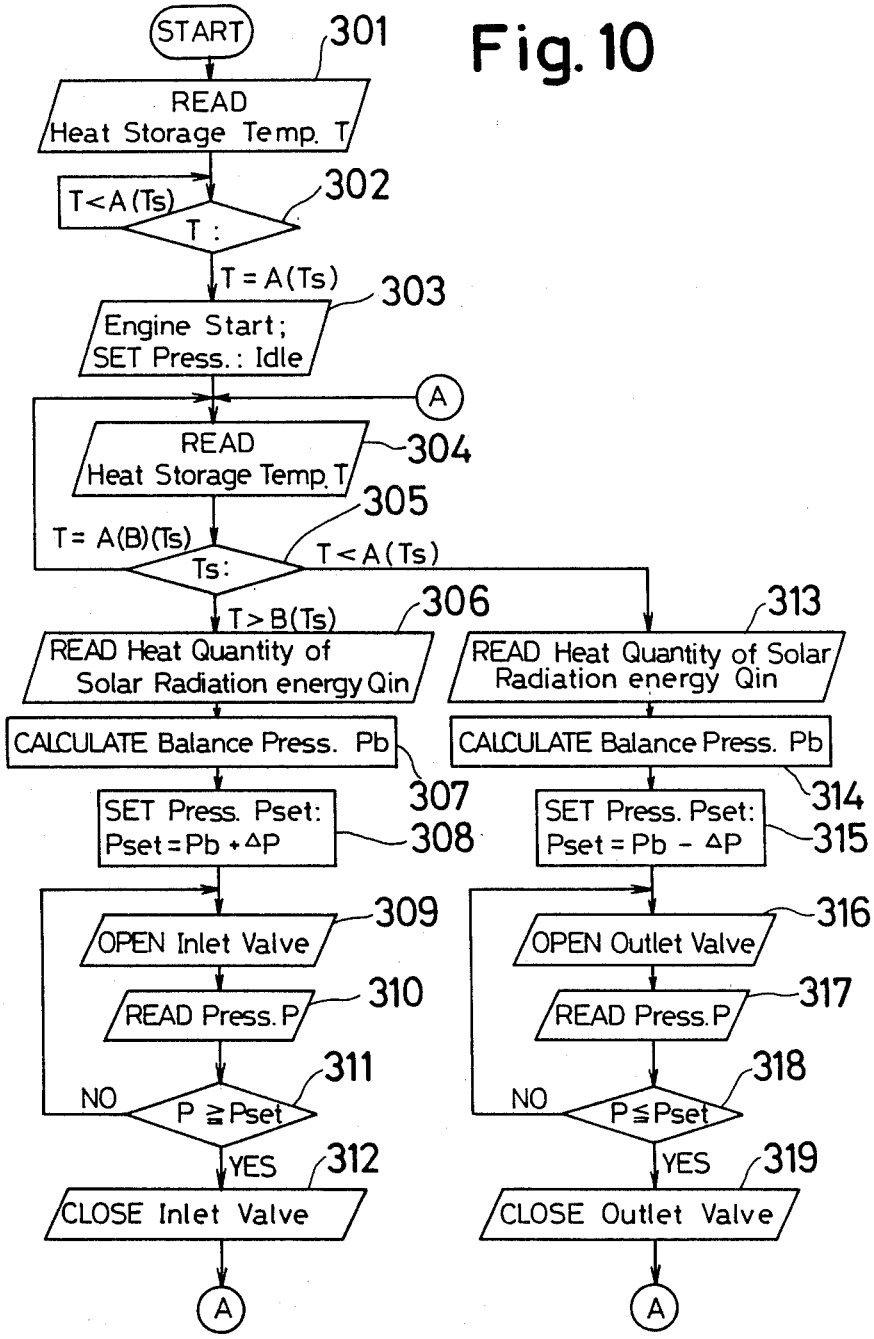
FIG. 10 shows a flow chart of the third operation mode of the engine.
Figure 11:
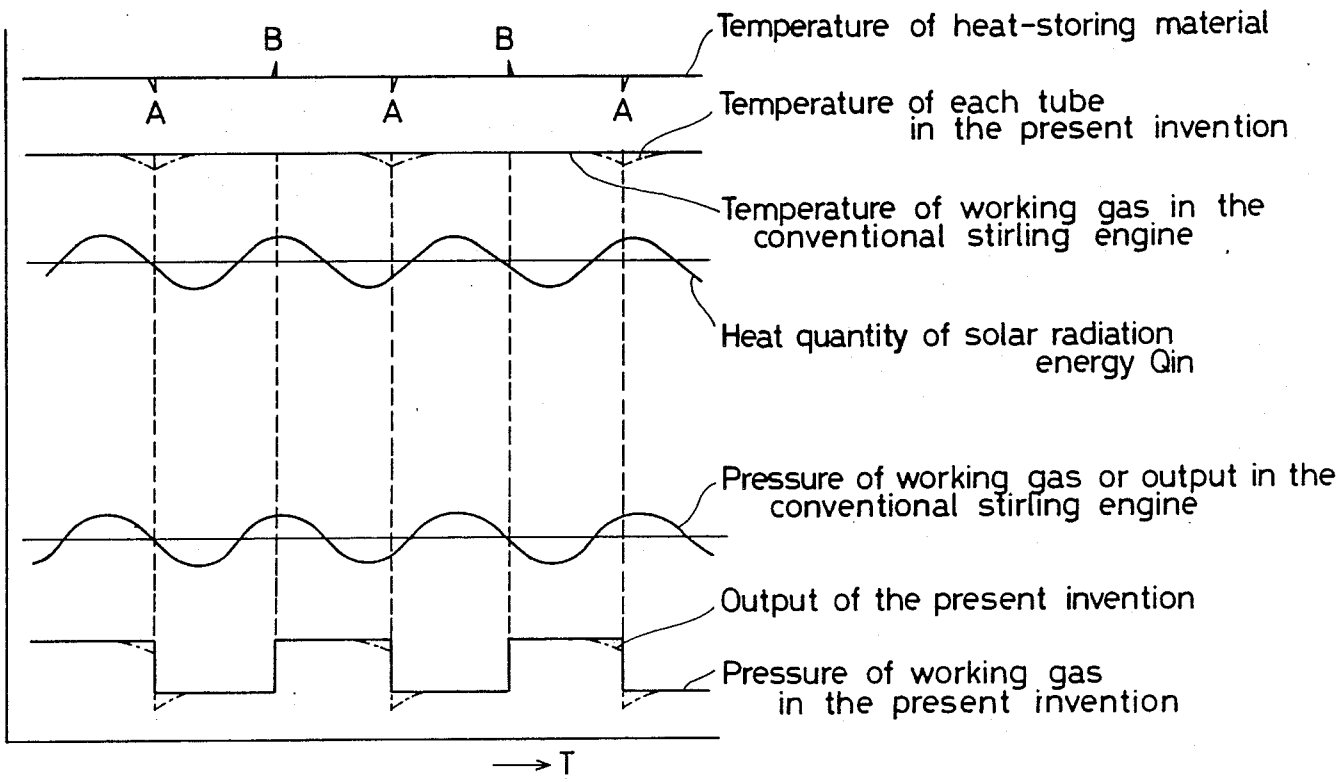
FIG. 11 is a chart in which characteristics of the present invention are compared with those of the conventional Stirling engine.

The foregoing operation mode is detailed in the flow chart shown in FIG. 10.

While this invention has been illustrated and described in accordance with preferred embodiments, it is recognized that variations and changes may be made herein without departing from the invention as set forth in the claims.

What is claimed is:

1. A Stirling engine comprising;

heater means for collecting solar radiation energy, a heater tube disposed in said heater means and connecting an expansion space and a compression space through a regenerator and a cooler;

a transparent partition disposed in said heater means and defining a closed space within which said heater tube is located;

a heat storage material positioned in said closed space;

temperature detecting means for detecting a temperature of said heat storage material;

pressure regulating means for regulating a pressure of a working gas in a working space from said expansion space to said compression space; and control means for controlling said pressure regulating means in response to a signal from said temperature detecting means.

2. A Stirling engine as recited in claim 1, wherein said pressure regulating means includes a supply source for supplying said working gas, said supply source being connected to said working space through a minimum-cycle-pressure line having a one-way valve permitting a flow of working gas into said working space and through a maximum-cycle-pressure line having a one-way valve preventing a flow of working gas into said working space, and a switching valve interposed between said supplying source and both of said lines, said switching valve being selectively switched by said control means between a first state in which communication between said supplying source and said maximum-cycle-pressure line is permitted and communication between said supplying source and said minimum-cycle-pressure line is prevented and a second state in which communication between said supplying source and said minimum-cycle-pressure line is permitted and communication between said supplying source and said maximum-cycle-pressure line is prevented.

3. A Stirling engine as recited in claim 2, wherein said switch valve maintains said first state until the temperature of said heat storage material is more than a melting point of said heat storage material, said switch valve being switched to said second state by said control means when the temperature of said heat storage material is more than a melting point of said heat storage material.

4. A Stirling engine as recited in claim 2, wherein said switch valve maintains said first state until the temperature of said heat storage material is more than a melting point of said heat storage material, and said switch valve is switched to said second state by said control means when the temperature of said heat storage material is more than a melting point of said heat storage material and is switched to said first step by said control means when the temperature of said heat storage material is less than a melting point of said heat storage material, whereby the temperature of said heat storage material is maintained at said melting point.

5. A Stirling engine as recited in claim 1, further comprising a measuring means for measuring radiation heat quantity of solar radiation energy and pressure detecting means for detecting the pressure of said working gas in said working space, wherein said control means predetermines a target pressure value in response to said signal from said temperature detecting means and a signal from said measuring means and causes said pressure regulating means to operate so as to change the pressure in said working pressure to said target pressure value.

6. A Stirling engine as recited in claim 5, wherein said pressure regulating means includes a supply source for supplying said working gas, said supply source being connected to said working space through a minimum-cycle-pressure line having a one-way valve permitting a flow of working gas into said working space and through a maximum-cycle-pressure line having a one-way valve preventing a flow of working gas into said working space, and an increasing pressure valve disposed in said minimum-cycle-pressure line and a decreasing pressure valve disposed in said maximum-cycle-pressure line.

7. A Stirling engine as recited in claim 6, wherein said control means compares a detected temperature of said temperature detecting means to said melting point of said heat storage material and calculates an ideal pressure value of said working gas in response to the radiation heat quantity measured by said measuring means, and said control means controls the opening and closing of said increasing pressure valve and said decreasing pressure valve so as to raise the pressure in said working space up to a value which is higher than the ideal pressure by a predetermined value when the temperature of said heat storage material is higher than said melting point and controls the opening and closing of said increasing pressure valve and said decreasing pressure valve so as to lower the pressure in said working space to a value which is lower than the ideal pressure by a predetermined value when the temperature of said heat storage material is lower than said melting point.

8. A Stirling engine as recited in claim 7, wherein said control means causes said increasing pressure valve and said decreasing pressure valve o operate so as to maintain the temperature of said heat storage material at said melting point.

* * * * *